US005408831A

United States Patent [19]

Guillard et al.

[11] Patent Number: 5,408,831

[45] Date of Patent: Apr. 25, 1995

[54] PROCESS AND INSTALLATION FOR THE PRODUCTION OF GASEOUS OXYGEN UNDER PRESSURE

[75] Inventors: Alain Guillard; Norbert Rieth, both of Paris, France

[73] Assignee: L'Air Liquide, Societe Anonyme pour l'Etude et l'Exploitation des Procedes Georges Claude, Paris, France

[21] Appl. No.: 161,545

[22] Filed: Dec. 6, 1993

[30] Foreign Application Priority Data

Dec. 30, 1992 [FR] France ..... 92 15925

[51] Int. Cl.[6] ..... F25J 3/02

[52] U.S. Cl. ..... 62/24; 62/32; 62/40; 62/42

[58] Field of Search ..... 62/24, 40, 32, 42

[56] References Cited

U.S. PATENT DOCUMENTS

| | | | |
|---|---|---|---|
| 1,240,397 | 9/1917 | Wolf | 62/42 |
| 1,354,380 | 9/1920 | Crommett et al. | 62/42 |
| 2,480,093 | 8/1949 | Anderson | 62/30 |
| 3,316,725 | 5/1967 | Dennis | 62/14 |
| 4,731,102 | 3/1988 | Yoshino | 62/40 |

FOREIGN PATENT DOCUMENTS

| | | |
|---|---|---|
| 0102190 | 3/1984 | European Pat. Off. . |
| 2578532 | 9/1986 | France . |

*Primary Examiner*—Ronald C. Capossela
*Attorney, Agent, or Firm*—Young & Thompson

[57] ABSTRACT

Process and apparatus for the production of gaseous oxygen under median pressure with a double distillation column (5). The low pressure column (7) of the double column (5)is operated under a pressure substantially greater than atmospheric pressure and slightly greater than the desired production pressure of oxygen, this low pressure being about 2 to 5 bars. The medium pressure column (6) of the double column (5) is under a corresponding pressure, namely, about 8 to 16 bars. The gaseous production oxygen is directly recovered from the base of the low pressure column, and the installation is maintained cold, at least in part, by free expansion of at least one gaseous product leaving the low pressure column.

14 Claims, 2 Drawing Sheets

PROCESS AND INSTALLATION FOR THE PRODUCTION OF GASEOUS OXYGEN UNDER PRESSURE

Figure 1:
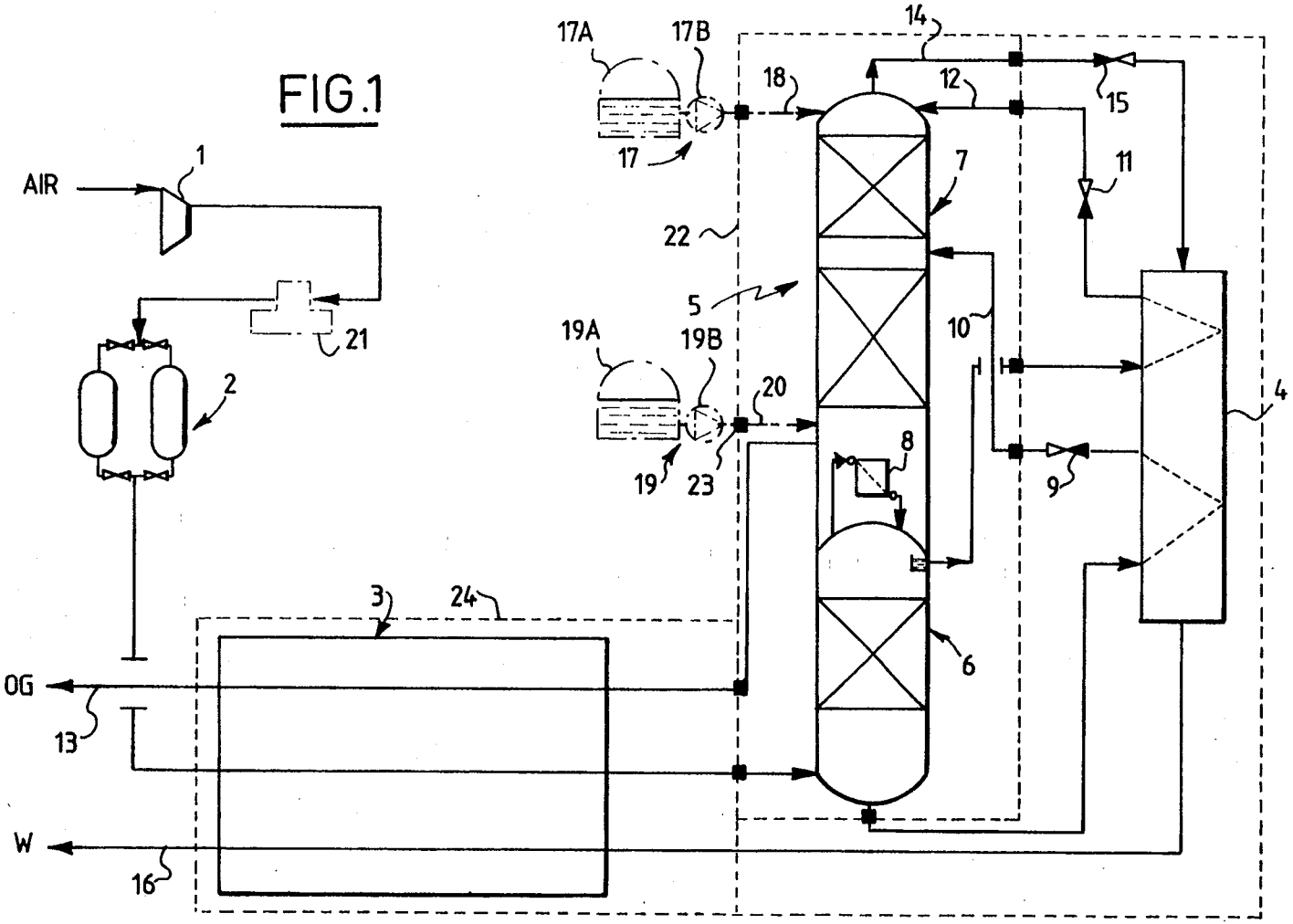

The present invention relates to a process for the production of gaseous oxygen under pressure by means of a double distillation column.

The pressures in question in the present text are absolute pressures.

The production of gaseous oxygen under pressure is generally performed either by compression of gaseous oxygen withdrawn from the low pressure column under a pressure close to atmospheric pressure, or by vaporization of liquid oxygen pumped to the production pressure. The corresponding installations are complicated, because they require special rotary machinery such as an oxygen compressor or one or several expansion turbines.

The invention has for its object to provide a process permitting the production in a particularly economical fashion of gaseous oxygen under moderate pressure.

To this end, the process according to the invention is characterized in that:

- the low pressure column is operated under a pressure substantially greater than atmospheric pressure and slightly greater than the oxygen product pressure, this low pressure being particularly of the order of 2 to 5 bars, and the medium pressure column is operated under a corresponding pressure, particularly of the order of 8 to 16 bars;
- gaseous oxygen product is recovered directly from the base of the low pressure column, and
- the installation is maintained cooled, at least in part, by free expansion of at least one gaseous product leaving the low pressure column.

According to other characteristics:

- a residual gas withdrawn from the head of the low pressure column is expanded by free expansion;
- there is injected into the low pressure column a flow of liquid nitrogen from a source external to the double column;
- there is injected into the low pressure column a flow of liquid oxygen from a source external to the double column;
- there is injected into the gaseous oxygen, at a point intermediate the thermal heat exchange line associated with the double column, a flow of liquid oxygen from a source external to the double column, and there is sent into said source, purge liquid oxygen withdrawn from the base of the low pressure column;
- the air to be treated is precooled, before its purification by adsorption, by means of a refrigeration cycle.

The invention also has for its object an installation adapted to practice such a process. This installation, of the type comprising: an air compressor; a purification apparatus for the compressed air; a double distillation column for the purified air, comprising itself a medium pressure column and a low pressure column connected by an evaporator/condenser; a heat exchange line to cool the air purified by indirect heat exchange with products from the double column; and means for maintaining the installation cold, is characterized in that the low pressure column operates under a pressure substantially greater than atmospheric pressure and slightly greater than the oxygen product pressure, this low pressure being particularly of the order of 2 to 5 bars, in that an oxygen product conduit is directly connected to the base of the low pressure column to withdraw from it gaseous oxygen, and in that the means to maintain cold comprise a free expansion valve for at least one gaseous product leaving the low pressure column.

In such an installation, the double column can in particular be insulated under vacuum, particularly by a vacuum jacket which contains only the double column and the conduit sections, the rest of the cold parts of the installation, except if desired the source of liquid nitrogen and/or liquid oxygen and the conduits leaving them, being insulated by a cold box at atmospheric pressure containing a solid insulation, especially particulate.

Figure 2:
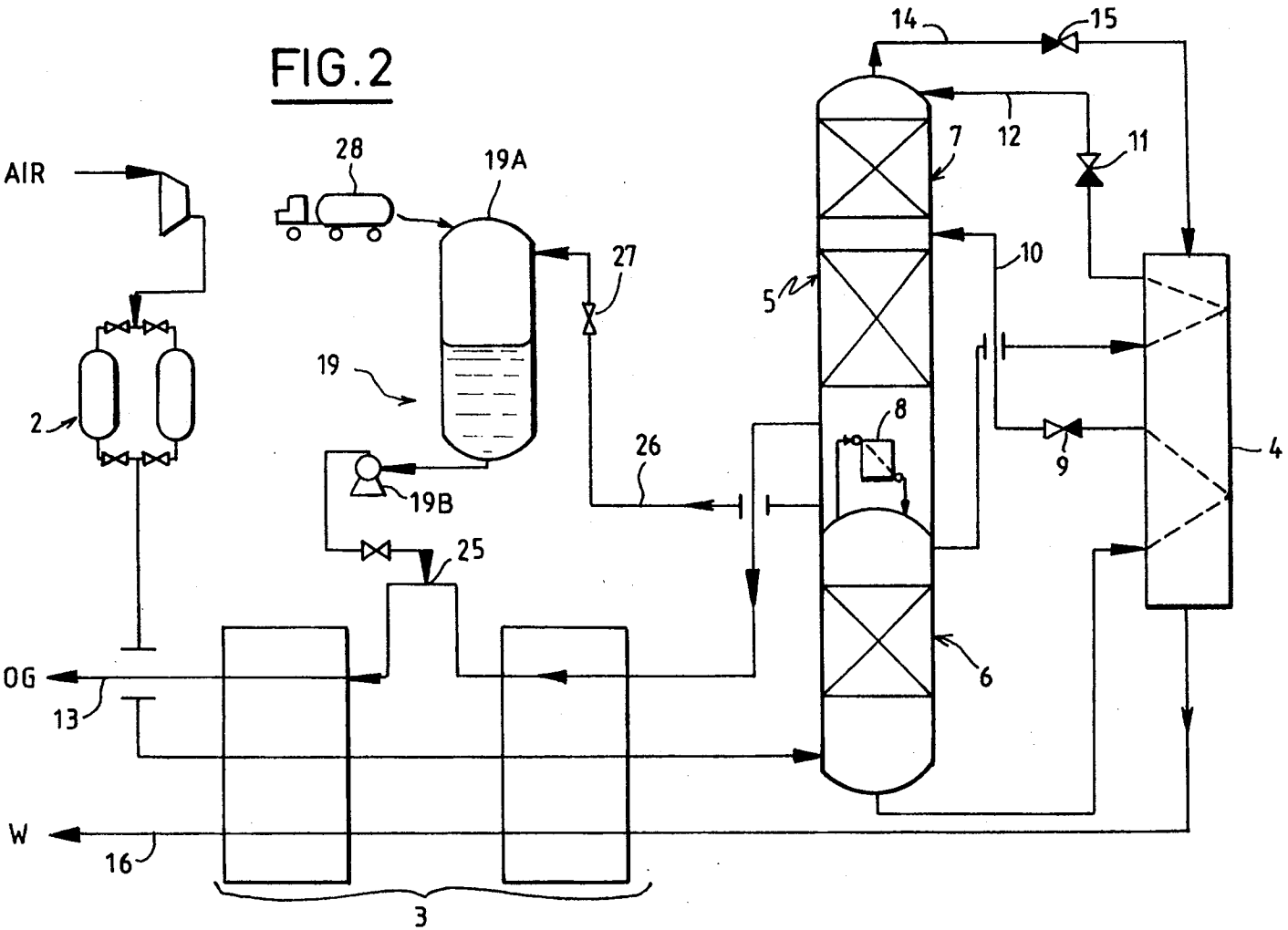

Examples of embodiment of the invention will now be described with respect to the accompanying drawings, in which:

FIG. 1 shows schematically an oxygen production installation according to the invention; and FIG. 2 shows schematically a variation.

The installation shown in FIG. 1 comprises essentially an air compressor 1, an apparatus 2 for purification by adsorption, a heat exchange line 3, a subcooler 4 and a double distillation column 5. This latter is essentially constituted by a medium pressure column 6 surmounted by a low pressure column 7, and by an evaporator/condenser 8 which places in indirect heat exchange the head vapor (practically pure nitrogen) of column 6 and the liquid (oxygen of the desired purity) in the base of column 7.

In operation, the air to be distilled is compressed in 1 to a pressure, so-called medium pressure, of the order of 8 to 16 bars, purified from water and carbon dioxide in 2, cooled to adjacent its dew point at 3 and introduced into the base of column 6. The "rich liquid" (air enriched in oxygen) collected in the base of this column is subcooled in 4, expanded in an expansion valve 9 to a pressure, called low pressure, which is substantially the production pressure, of the order of 2 to 5 bars, and introduced at an intermediate level of the column 7 via a conduit 9. "Poor liquid" (practically pure nitrogen) collecting in the head of column 6 is subcooled in 4, expanded in an expansion valve 11 to the low pressure, and introduced into the head of column 7 via a conduit 12. The product oxygen is withdrawn in gaseous phase from the base of column 7, reheated in the heat exchange line 3 and directly recovered as product via a product conduit 13.

To keep the installation cold, the residual gas W (impure nitrogen), withdrawn from the top of column 7 via a conduit 14, is expanded by free expansion to a pressure slightly greater than atmospheric pressure in an expansion valve 15, reheated in the subcooler 4 then in the heat exchange line 3, and evacuated via a conduit 16. This gas can serve to regenerate the adsorbers of the apparatus 2.

If the refrigeration produced by this free expansion is insufficient, it can be complemented by at least one of the following means, shown in broken line in the drawing:

- A source 17 of liquid nitrogen under the low pressure, connected to the head of column 7 via a conduit 18 and provided with flow regulation means. As shown, it can comprise particularly a supply 17A of liquid nitrogen under atmospheric pressure provided at its outlet with a pump 17B.

A source 19 of liquid oxygen under the low pressure, connected to the base of the column 7 via a conduit 20 and provided with flow regulation means. As shown, it can also be a supply 19A of liquid oxygen under atmospheric pressure provided at its outlet with a pump 19B.

A refrigeration cycle 21, for example an ammonia cycle, mounted between the compressor 1 and the purification apparatus 2 and precooling the compressed air to a temperature of the order of 0° to +5° C. for example.

The illustrated installation is thermally insulated in the following manner.

On the one hand, the double column 5 is disposed in a vacuum jacket 22, which ensures high performance insulation. This jacket contains, in addition to the double column, only the conduit sections which enter it or leave it, these conduits passing through the jacket by means of suitable connections 23. In practice, it is preferable to group all the connections 23 in a same region of the jacket.

On the other hand, with the exception of the cryogenic liquid sources 17 and 19 and the conduits which leave them, which have their own insulation, generally under vacuum, all the other cold parts of the installation are insulated by means of a cold box 24 under atmospheric pressure containing a solid particulate insulating material, which is preferably perlite.

This manner of insulation is very advantageous: on the one hand, the vacuum jacket can have a diameter closely adapted to the external diameter of the double column, which can be of constant diameter over all its height, which permits effecting a double column 5-jacket 22 assembly which is conveniently transportable.

Moreover, all the cold accessories such as 9, 11, 15 are easily accessible because they are continuously at atmospheric pressure.

From an energy point of view, this solution is also very advantageous, while at the same time being much less costly than vacuum insulation enclosing all of the installation. Thus, in an air distillation installation, 75 to 85% of the thermal losses arise from the double column and, in the heat exchange line, the losses are concentrated in the coldest part. In total, the insulation efficiency of the assembly 22–24 is of the order of 90% of that which would be obtained with vacuum insulation of all of the installation.

As a modification, the double column can comprise a "minaret", which is to say an upper portion of the low pressure column 7 permitting producing at its summit gaseous nitrogen under the low pressure. In this case, this gaseous nitrogen could also be expanded in a expansion valve to about atmospheric pressure to produce cold, before being reheated in 4 and then 3 and then being recovered as a second product of the installation.

The simplicity of the installation according to the invention renders the latter particularly interesting for the production of moderate quantities, for the example of several tens of tons per day, of gaseous oxygen under a pressure of several bars.

In the modification shown in FIG. 2 without its thermal insulation, the installation is kept cold by free expansion of the residual gas W in 15, complemented by a quantity of liquid oxygen from a source 19 constituted as before by a supply 19A at atmospheric pressure and a pump 19B.

However, in this modification, the added liquid oxygen, pumped at 19B to a pressure somewhat higher than the low pressure, is injected at an intermediate point 25 of the heat exchange line 3, into the gaseous oxygen which is undergoing reheating.

Moreover, a conduit 26 for purging liquid oxygen, provided with a valve 27, leaves the base of the column 7 and opens into the supply 19A to partially replenish it, the remainder of the liquid oxygen being supplied by tank trucks 28.

The purge, adapted to evacuate the hydrocarbons from the column 7, corresponds to about 0.2% of the flow of the air treated and is preferably effected discontinuously, generally automatically; it is independent of the "bottle feeding" of the installation with liquid oxygen.

The point of injection 25 is so selected that the liquid oxygen will vaporize at a temperature sufficiently high that the hydrocarbons will have no danger of explosion or ignition during vaporization of the oxygen. This temperature can thus be of the order of −100° C.

What is claimed is:

1. Process for the production from air of gaseous oxygen under medium pressure in an installation with a double distillation column (5) comprising a medium pressure column (6) and a low pressure column (7), comprising:

maintaining the low pressure column (7) under a pressure greater than atmospheric pressure and greater than a desired production pressure of oxygen, of about 2 to 5 bars, maintaining the medium pressure column (6) under a pressure of about 8 to 16 bars;

directly removing gaseous product oxygen from the base of the low pressure column, and maintaining the installation cold by expansion of at least one gaseous product leaving the low pressure column.

2. Process according to claim 1, wherein said expanded gaseous product is a residual gas (W) withdrawn from the head of the low pressure column (7).

3. Process according to claim 1, further comprising injecting (at 18) into the low pressure column (7) a flow of liquid nitrogen from a source (17) external to the double column (5).

4. Process according to claim 1, further comprising injecting (at 20) into the low pressure column (7) a flow of liquid oxygen from a source (19) external to the double column (5).

5. Process according to claim 1, further comprising injecting into said gaseous product oxygen (at 25), at a point intermediate the length of a heat exchange line (3) associated with the double column (5), a flow of liquid oxygen from a source external to the double column, and sending to this source (19) liquid oxygen withdrawn (at 26) from the base of the low pressure column (7).

6. Process according to claim 1, wherein the air is precooled by means of a refrigeration cycle (21) and then purified by adsorption (at 2).

7. In an installation for the production of gaseous oxygen under pressure, comprising: an air compressor (1); an apparatus (2) for purification of the compressed air; a double column (5) for distillation of the purified air, the double column comprising a medium pressure column (6) and a low pressure column (7) connected by an evaporator-condenser (8); a heat exchange line (3) to cool the purified air by indirect heat exchange with products from the double column; and means (15, 17–18, 19–20, 21) for keeping the installation cold; the improvement wherein the low pressure column (7) is under a pressure greater than atmospheric pressure and greater than the oxygen production pressure, said low pressure being about 2 to 5 bars, a column (13) for oxygen production directly connected to the base of the low pressure column to withdraw therefrom gaseous oxygen, and cold supply means comprising a valve (15) for expanding at least one gaseous product leaving the low pressure column (7) prior to introduction of the expanded product into said heat exchange line.

8. Installation according to claim 7, wherein the expansion valve (15) is mounted in a conduit (14) for removal of residual gas (W) from the head of the low pressure column (7).

9. Installation according to claim 7, wherein the cold supply means comprise a source (17) of liquid nitrogen under the low pressure connected to the head of the low pressure column (7) to inject thereinto a predetermined flow of liquid nitrogen.

10. Installation according to claim 7, wherein the cold supply means comprise a source (19) of liquid oxygen under the low pressure connected to the base of the low pressure column (7) to inject thereinto a predetermined flow of liquid oxygen.

11. Installation according to claim 7, wherein the cold supply means comprise a source (19) of liquid oxygen under the low pressure connected at an intermediate point of a heat exchange line (3) for cooling incoming air, to reheating passages for gaseous oxygen, and a purge conduit (26) that connects the base of the low pressure column (7) to the source of liquid oxygen (19).

12. Installation according to claim 7, which further comprises a refrigeration cycle (21) for precooling the compressed air, mounted between the compressor (1) and the purification apparatus (2).

13. Installation according to claim 7, wherein the double column (5) is vacuum insulated by a vacuum jacket (22) which contains only the double column and the conduit sections, the rest of the cold parts of the installation being insulated by a cold box (24) at atmospheric pressure containing a solid insulation.

14. Installation according to claim 13, wherein said solid insulation is particulate.

* * * * *